US009796934B2

(12) United States Patent
Gomez

(10) Patent No.: US 9,796,934 B2
(45) **Date of Patent: *Oct. 24, 2017**

(54) SYSTEM AND METHOD TO DECREASE THE VISCOSITY OF THE CRUDE OIL AND THE POTENTIATION OF DEHYDRATION

(71) Applicant: Luis Gomez, Hollywood, FL (US)

(72) Inventor: Luis Gomez, Hollywood, FL (US)

( * ) Notice: Subject to any disclaimer, the term of this patent is extended or adjusted under 35 U.S.C. 154(b) by 223 days.

This patent is subject to a terminal disclaimer.

(21) Appl. No.: 14/789,538

(22) Filed: Jul. 1, 2015

(65) Prior Publication Data

US 2016/0369178 A1 Dec. 22, 2016

(30) Foreign Application Priority Data

Jun. 18, 2015 (MX) ..... MX/A/2015/007857

(51) Int. Cl.
*C10G 33/02* (2006.01)
*C10G 15/08* (2006.01)
*C10G 32/02* (2006.01)

(52) U.S. Cl.
CPC ..... *C10G 33/02* (2013.01); *C10G 15/08* (2013.01); *C10G 32/02* (2013.01); *C10G 2300/202* (2013.01); *C10G 2300/302* (2013.01)

(58) Field of Classification Search
CPC ..... C10G 33/02; C10G 15/08; C10G 32/02; C10G 2300/202; C10G 2300/302; C10G 32/00; C10G 2300/301; C10G 2400/16; C10G 29/02; C10G 47/34; C10G 2300/1014; C10G 2300/205; C10G 2300/1033; F02M 27/04; F02M 33/00; B01D 53/8603; C09K 3/32
See application file for complete search history.

(56) References Cited

U.S. PATENT DOCUMENTS

| | | | | |
|---|---|---|---|---|
| 4,247,398 | A | 1/1981 | Mohri | |
| 4,429,665 | A | 2/1984 | Brown | |
| 5,013,450 | A | 5/1991 | Gomez | |
| 6,712,050 | B1 | 3/2004 | Gomez | |
| 9,393,520 | B2 | 7/2016 | Gomez | |
| 2010/0010282 | A1* | 1/2010 | Acosta Estrada ..... | C09K 3/32 588/313 |

* cited by examiner

*Primary Examiner* — Xiuyu Tai
(74) *Attorney, Agent, or Firm* — Robert C. Kain, Jr.

(57) ABSTRACT

A method and system for reducing viscosity in the crude oil and the empowerment of its dehydration process pass crude oil over a core that ionizes-polarizes the crude oil with an electrostatic charge. The metal bar core made of an alloy which includes, a weight of, 40-70% copper, 10-32% nickel, 15-40% zinc, 2-20% tin, and 0.05-10% silver. The metal bar core comprises a plurality of grooves, which allows crude oil to be agitated as it comes in contact with the core, activating an electrostatic charge. The electrostatic charge of the core creates a magnetic catalytic reaction that causes: (1) a molecular separation in the molecular chains within crude oil thereby lowering the viscosity and (2) stretches and twists caused by the molecular ionization-polarization of crude oil, causes that this release accordingly congenital or added water that is trapped in it, resulting in a potentiation of the dehydration of crude oil.

15 Claims, 8 Drawing Sheets

Molecular Crude Oil Chain before treatment

Molecular Crude Oil Chain after treatment

Electron Microscope spectral analysis

SYSTEM AND METHOD TO DECREASE THE VISCOSITY OF THE CRUDE OIL AND THE POTENTIATION OF DEHYDRATION

This is a regular patent application claiming priority under 35 U.S.C. 119 (a) to Mexican Patent Application No. MX/a/2015/007857 filed on Jun. 18, 2015 for a system and method to decrease the viscosity of the crude oil and the empowerment of their dehydration.

The present invention relates to a method for treating crude oil (hereinafter may be referred to only as "crude") in a way that (a) crude oil maintains one viscosity less than a given temperature and (b) strengthen the methods for the removal of water (dehydration). Low viscosity allows oil to be maintained in a liquid state and fluid at low temperatures and without heat, when normally it would not be so. As for the decrease of viscosity, this eliminates the need for heating oil in order to pump it and transport it steadily and even for certain crude, can eliminates the need to use chemicals flow improvers. With regard to the dehydration of crude oil, it potentates the effect of emulsion compatible with the technology described here and specific chemicals.

BACKGROUND OF THE INVENTION

It is well known that most of the crude is heavy and the handling and transportation of these is a complicated issue, which involves high costs. In addition, to extract crude from an oil well, usually extracted first light crude or less heavy, leaving the final extraction of crude heavy, extra heavy and ultra heavy, so, with the passage of time the trend towards how ruling the latter, will be higher. Now, to improve the extraction of crude oil, many wells are assisted by injecting dry steam or water to promote an improvement in the production of oil wells, however, causing crude oil containing one higher percentage of water to the be removed, what it ends up turning into a complication. An aspect of the present invention, is to avoid the current practice of heating of crude oil during all processes of handling or transportation of this until it is used or stored, in turn, help enhance the methods of disposal of the crude water (both congenital and added).

Crude oil is a hydrocarbon normally high viscosity that requires temperature between 50° C.-80° C. to pump it or transport it from the source to its final destination. In the majority of occasions, chemicals flow improvers are used for the facilitation of this work.

Now, in regards to the water contained in the crude oil, both congenital and added, the percentages can occur practically in any proportion (from 10% or less, up to 70% or more).

What is sought with the present invention is to eliminate or significantly reduce many of the costs involving the heating of crude oil and the use of chemical products for improvement of flow or dehydration (emulsion breakers), while the same processes become more efficient.

Keep warm crude during all line transport, storage tanks and chemicals flow and dehydrators improvers, involves a considerable cost. Add to this the penalty for exceeding the maximum percentage of water and salt allowed as an international standard for selling oil and the decline for crude oil that is left in the tanks; Since the heating methods cannot ensure provide heat to the entire contents of the tanks. You can understand that the figure rises, but we are certain that can greatly be reduced through the use of the present invention.

OBJECTS OF THE INVENTION

It is the object of the present invention, to treat crude oil with a device disposed in a crude oil supply line so that (a) crude oil maintains one viscosity less than a given temperature and (b) potentiates the methods for dehydration. Low viscosity allows oil to be maintained in a liquid state and fluid at low temperatures and without heat, when normally it would not be so.

The device that is used to treat crude oil consists of 2 parts: a metal casing tube-shaped, designed to connect directly to the line of transportation of crude oil pipeline and a center or core in its interior, which consists of five different in a unique configuration and design metals (see FIG. 8), which allows crude is agitated or swirling as it gets in contact with the core by activating the electrostatic charge by means of friction.

Derived from the electrostatic charge induced on the crude, this invention produces an ionization-polarization in molecules of crude oil, achieving lower viscosity, so that it is able to maintain a liquid state so it can be manipulated or transported without heating. This same ionization-polarization in crude oil molecules facilitates the release of congenital or added water contained in it, thus potentiating the physical and chemical methods used for this purpose, when the chemicals are compatible with this invention.

BRIEF SUMMARY OF THE INVENTION

The present invention is a method for viscosity decrease in crude oil and the potentiating of dehydration, passing oil on a core that polarizes an electrostatically charged. The core consists of a metal bar made of an alloy, which includes, by weight, 40-70% copper, 10-32% nickel, 15-40% zinc, 2-20% tin, and 0.05-10% silver. The core is within a housing having an inlet and an outlet at their ends to receive and download the crude is to be treated. The Center or core is disposed in a crude oil supply line. The metal bar of the core comprises a plurality of cuts that have a concave shape and arranged diagonally along an entire surface of an upper and lower face of the metal bar of the core to create grooves, which allows crude oil to be agitated as it comes in contact with the core, activating the electrostatic charge.

The electrostatic charge generated by the core, create a magnetic catalytic reaction that causes a molecular alignment in crude oil molecular chains, thus reducing the viscosity of the same. The lower viscosity maintains crude oil in a liquid state for pumping and transport. The electrostatic charge generated by the core creates a magnetic catalytic reaction that causes a lengthening/stretching in the crude oil molecules, this coupled with the ionization-polarization thereof, creates a kind of molecular torsion that helps crude oil to release the water molecules trapped in it.

This occurs because the atoms of the metals have a very broad spectrum of electrons around its core, which affects the molecules and atoms of other elements that come in contact with them, for our particular case, molecules and atoms of the crude oil and the elements contained in it (water and salt).

Theory tells us that the molecular ionization-polarization process produces disorganization and breakdown of the particles responsible for the formation of gel (conglomerate), which leads to an improvement in the flow of crude oil. As a result, it is possible for crude oil to remain fluid at temperatures of 0° C.

In a crude oil that has not been ionized-polarized, aromatic tend to attract electrostatically (called pi-pi stacking effect) and due to the planarity of aromatic rings, are capable of Covalent not each other. Finally, this; results in a structure stabilized and strengthened through additional links. These links can be easily broken, especially through the effects of temperature (above 90° C.).

However, when crude oil is heated and polarized, the aromatics are not able to interact freely with each other and prevents the formation of the effect of pi-pi stacking Instead, a homogeneous mixture of aromatic and paraffin is formed. The structure formed by this mixture of aromatics and paraffin, not stabilized or reinforced by links additional non-Covalent and that is the reason why crude oil can stay liquid or fluid at lower temperatures.

Having this crude oil weakened structure, additionally contributes to the molecules of the same release the external elements contained in them (water mainly), which enhances the efficiency of the chemicals for disposal (dehydration).

BRIEF DESCRIPTION OF THE DRAWINGS

Further objects and advantages of the present invention can be found in the detailed description of the preferred embodiments when taken in conjunction with the accompanying drawings in which.

DETAILED DESCRIPTION OF THE PREFERRED EMBODIMENTS

Crude oil is treated with a core prepared in a crude oil supply line so that (a) crude oil maintains one viscosity less than a given temperature and (b) potentiates the methods for dehydration. The core is disclosed in U.S. Pat. No. 6,712,050. The core being used to treat crude oil consists of five different metals in a unique and patented arrangements of grooves, which allows crude oil to be agitated or swirl as it comes in contact with the core, activating the electrostatic charge. The core is made of an alloy comprising, by weight, 30-60% copper, 10-30% nickel, 15-40% zinc, 5-20% tin, and 1-10% silver. The core is in a closed tube, which is directly connected to the crude oil supply, preferably at the production site.

When oil is passed through the device and it frictions with the core, constant magnetic field is created affecting the molecules of the oil. The crude acts as a dielectric, which creates an ionization-polarization. The effect blends the hydrocarbons and alkanes. Additionally, the water in the crude oil usually contains a high amount of salt, which is released, therefore acts as an excellent conductor of electricity. When crude oil comes out of the core having been subjected to the magnetic field, ionization-polarization and molecular refraction, the crude's molecular geometry and viscosity have been significantly modified and will remain low even in temperatures below 15° C. In fact, tests have shown treated crude oil remaining in the liquid state in temperatures above 0° C.

Figure 1A:
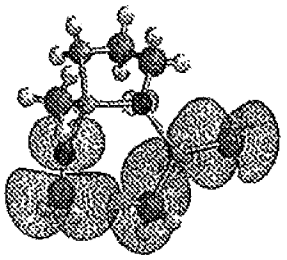
FIG. 1A is the molecular chain of the crude oil before to treatment.
Figure 1B:
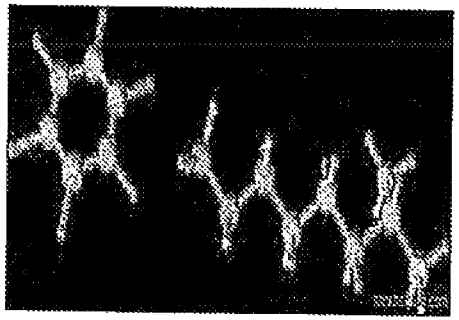
FIG. 1B is the molecular chain of crude oil after a treatment.
Figure 1C:
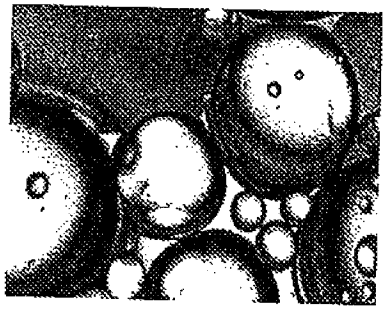
FIG. 1C is an electron microscope spectral analysis of the chain of crude oil after treatment.

The device disposed in the supply of crude oil line does not consume any extra energy. As shown in FIGS. 1A, 1B and 1C as the crude passes over the core, electrostatically charged molecules with the same polarity adheres to the thesis of mutual rejection and thus creates a finer structure of the molecular of crude oil chain. FIG. 1A depicts the molecular crude oil chain before passing over the core, which is herein also called treatment. FIG. 1B depicts the molecular crude oil chain after treatment. FIG. 1C is an electron microscope spectral analysis of crude oil after treatment. The outgoing liquid, or ionizer-polarized liquid, which has a finer structure, can be transported to the consumer, or pumped into transport vessels without any further treatment or heating, there by revolutionizing the cost structure for creation and of crude oil.

Crude oils are a compound of linear, cyclic, aromatic alkanes, water, salts, some metals and sulfur. The ratio of these components is diverse and there is no general pattern: each deposit is particular in its composition of molecules. The real constant is that crude oil is kept flowable, that is to say has the viscosity that allows it to flow easily in temperatures above 60° C. When lowering the temperature, the intermolecular energy diminishes causing them to contract, inducing this increase of viscosity.

As discussed, viscosity is closely connected with the order of the molecules within the liquid and their interaction with the surface of the liquid (surface tension). The effects of a magnetic field on the properties of the liquids have been studied; this branch of physics is known as magnetohydrodynamics. A magnetic field represents or is a manifestation of energy, and if we take into consideration the magnetic nature of organic molecules (covalent), it is expected that in the proportion of the intensity of the magnetic field the shape of the molecules is altered. The Stereoisomerism explains how a compound with the same molecular weight and the same atom proportions, can present different physical and chemical properties.

In the case of the core, the magnetic field is generated in cylindrical core-carrying chamber. This magnetic field is constant and permanent, and affects the "empty" spaces of the organic molecules of the crude oil passing through and over and around the core. Furthermore, crude oil acts as a dielectric member (a material that conducts electric energy poorly) which generates a polarization in it, a fact that prompts a "bending" of the alkanes (cyclical and linear). During this process, encapsulated water with a high salt content is released, and therefore the water release acts as an excellent conductor of electricity.

When these forces act on the liquid crude oil (magnetic field, polarization) by orientation, molecular refraction-Intermolecular forces of crude oil before passing through the center of ionization-polarization, crude oil is reorganized with "new" (mainly of the type Van der Walls) Intermolecular forces; crude oil has changed its molecular geometry and, in this process, the viscosity of the treated crude remains low even at temperatures below 15° C. In addition, testings have shown that treated oil remains in a liquid state at temperatures around 0° C. We must consider that the intensity of the magnetic field (and its side effects) cause the "separation" of radical. Evidence of the testing indicates that treated oil has an effect on the content of salts, sulphur and composition thereof.

EXAMPLE I

Three crude oil samples were received: (1) oil control, (2) ionized-polarized oil sample 1 and (3) crude ionized-polarized sample 2. The three samples were examined with differential scanning calorimetry (hereinafter referred to as "DSC") by using "DSC823e Mettler Toledo", device, the results of which are shown in FIGS. 2 to 7. The basic principle underlying this technique is that when the sample undergoes a physical transformation such as phase transitions, more or less heat will be need to flow to it than the reference to maintain both at the same temperature. Whether less or more heat must flow to the sample depends on whether the process is exothermic or endothermic. For example, as a solid sample melts to a liquid, it will require more heat flowing to the sample to increase its temperature at the same rate as the reference. This is due to the absorption of heat by the sample as it undergoes the endothermic phase transition from solid to liquid.

Figure 2:
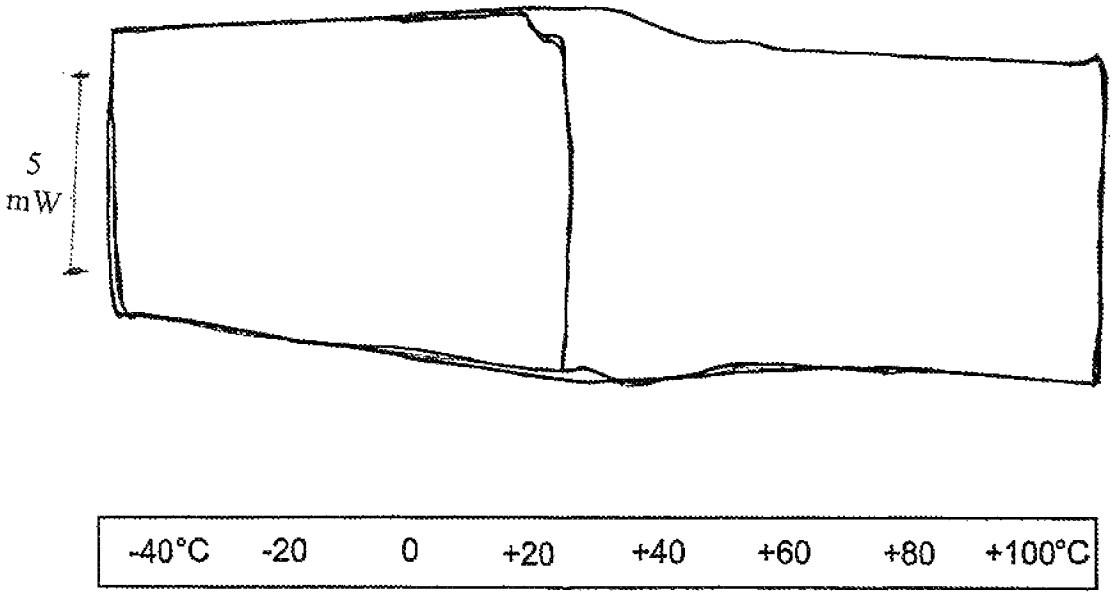
FIG. 2 is is the differential scanning calorimetry temperature log of the crude control sample.
Figure 3:
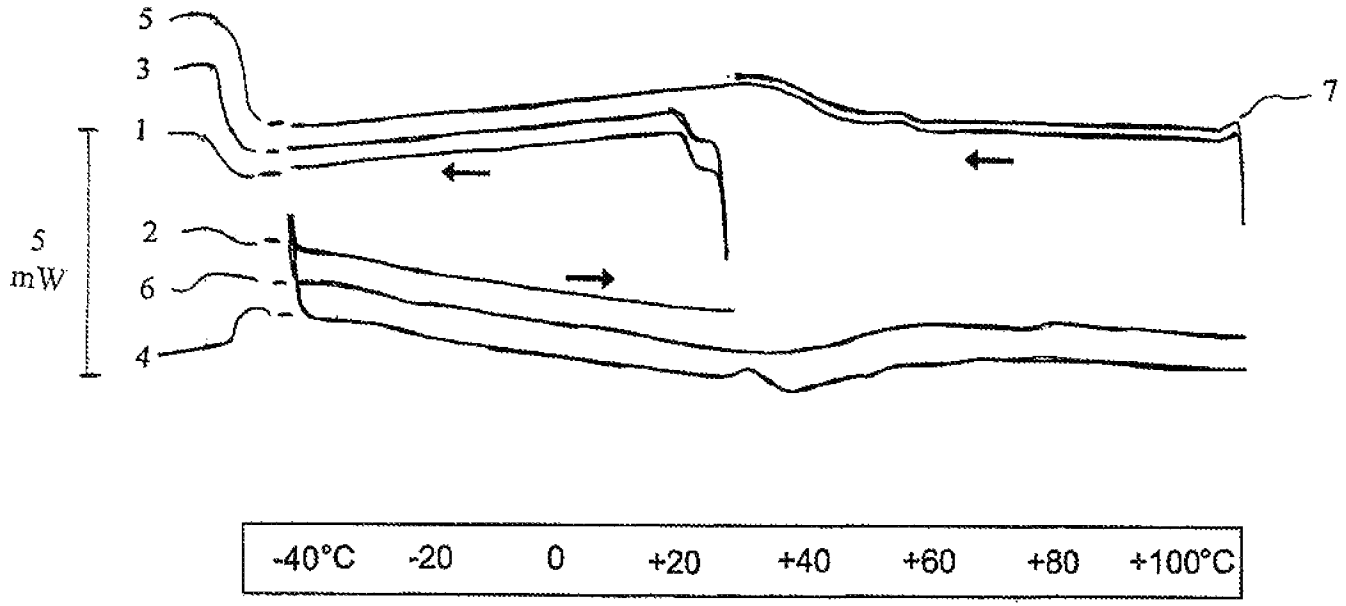
FIG. 3 is the differential scanning calorimetry temperature log of the control crude sample with marked cycles of cooling and heating.
Figure 4:
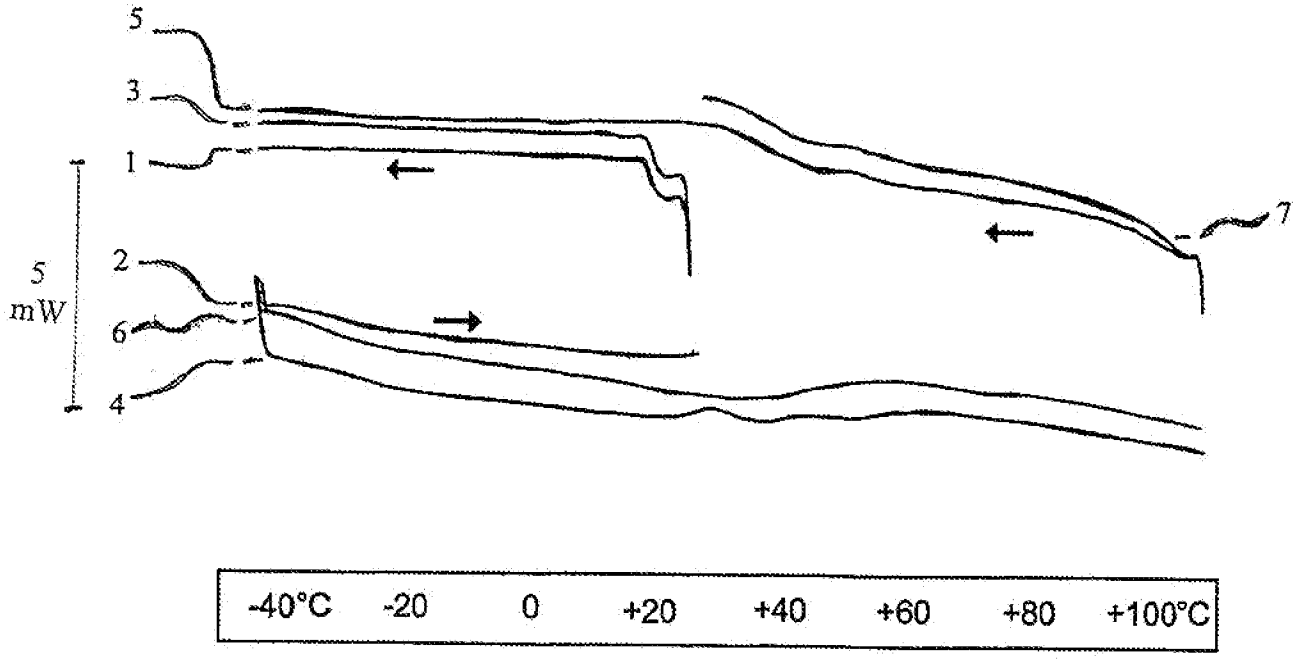
FIG. 4 is the differential scanning calorimetry temperature log of the control of ionized-polarized crude sample with marked cycles of cooling and warming.
Figure 5:
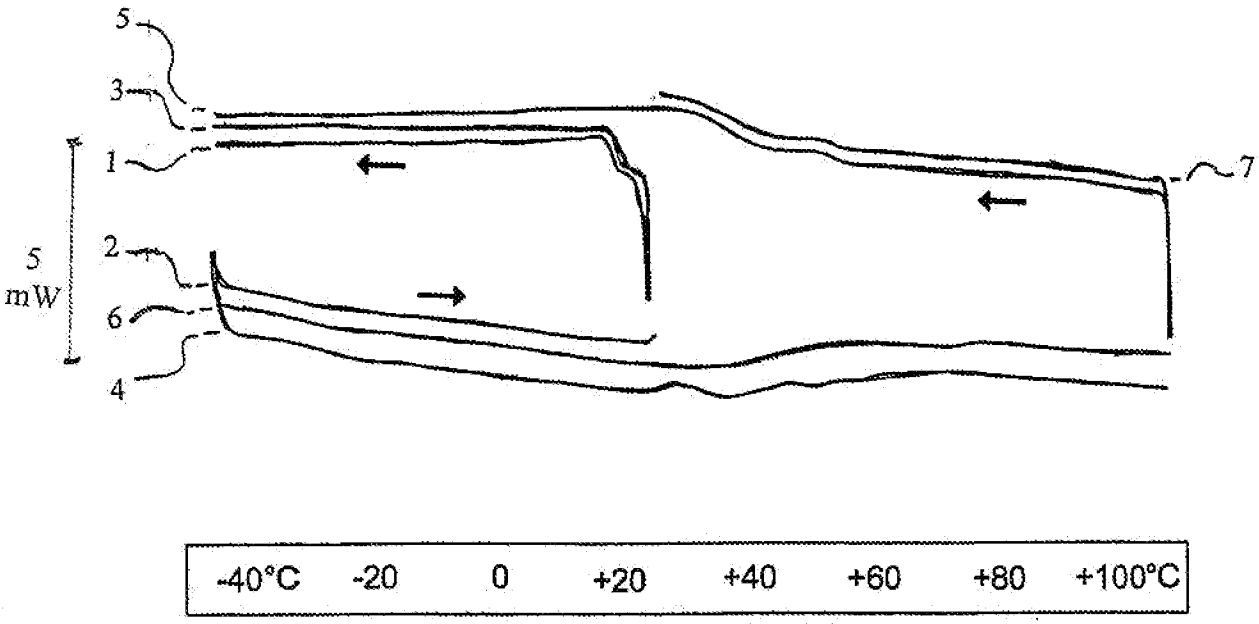
FIG. 5 is the differential scanning calorimetry temperature log of the control of polarized crude oil sample 2 with marked cycles of cooling and heating.

Measurement was conducted in four levels of cooling and three levels of heating with speed of 10° C./min in nitrogen environment: (1) cooling 25° C. to −40° C., (2) heating from −40° C. to 25° C., (3) cooling from 25° C. to −40° C., (4) heating from −40° C. to 100° C., (5) cooling from 100° C. to −40° C., (6) heating of −40° C. to 100° C., (7) cooling from 100° C. to 25° C. In FIGS. 2-7, the x axis reflects the temperature and the y axis reflects the heat flow or power differential (mW). Example of one complete temperature log, with all measuring cycles, is shown in FIG. 2. FIG. 3 shows a DSC temperature log of crude oil of sample with marked cycles of cooling 1, 3, 5 and 7 and heating 2, 4 and 6. FIG. 4 shows a DSC temperature log of crude oil sample 1 with marked cycles of cooling 1, 3, 5 and 7 and heating 2, 4 and 6. FIG. 5 shows DSC temperature log of crude oil sample 2 with marked cycles of cooling 1, 3, 5 and 7 and heating 2, 4 and 6.

Figure 6:
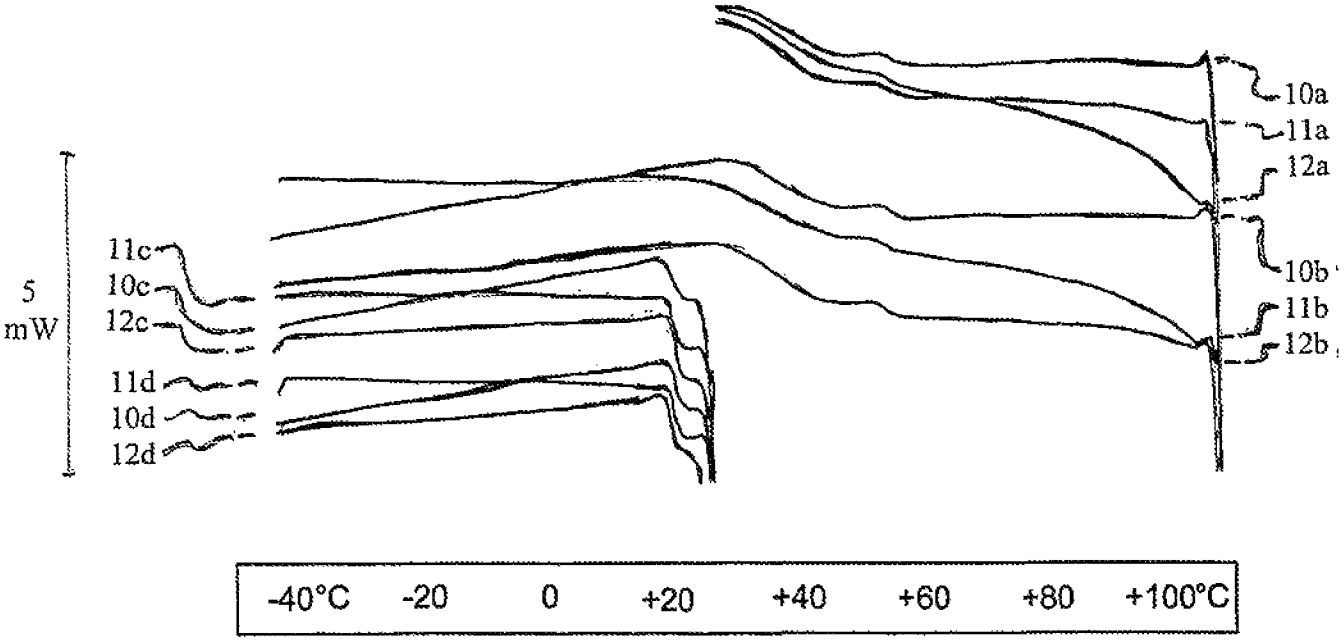
FIG. 6 is the differential scanning calorimetry temperature log of the control of crude oil ionized-polarized sample 1 and crude-ionized-polarized sample 2.

FIG. 6 shows a DSC temperature log of all three (3) samples showing cooling. Control crude oil 10, ionized-polarized sample 1 11, and ionized-polarized crude oil sample 2 12 are shown being cooled at four temperatures. The samples were cooled from 100° C. to 25° C. The results of this cooling is shown as crude 10*a*, ionized-polarized control oil sample 1 11*a* and ionized-polarized crude oil sample 2 12*a*. The samples were cooled from 100° C. to −40° C. The results of this cooling are shown as control crude oil 10*b*, ionized-polarize sample 1 11*b* and ionized-polarized crude oil sample 2 12*b*. The samples were cooled from 25° C. to −40° C. The results of this cooling is shown as control crude oil 10*c*, ionized-polarized sample 1 11*c*, and ionized-polarized crude oil sample 2 12*c*. The samples were heated and cooled again from 25° C. to −40° C. The results of this cooling are shown as crude oil 10*d*, ionized-polarized sample 1 11*d* and ionized-polarized crude oil sample 2 12*d*.

Figure 7:
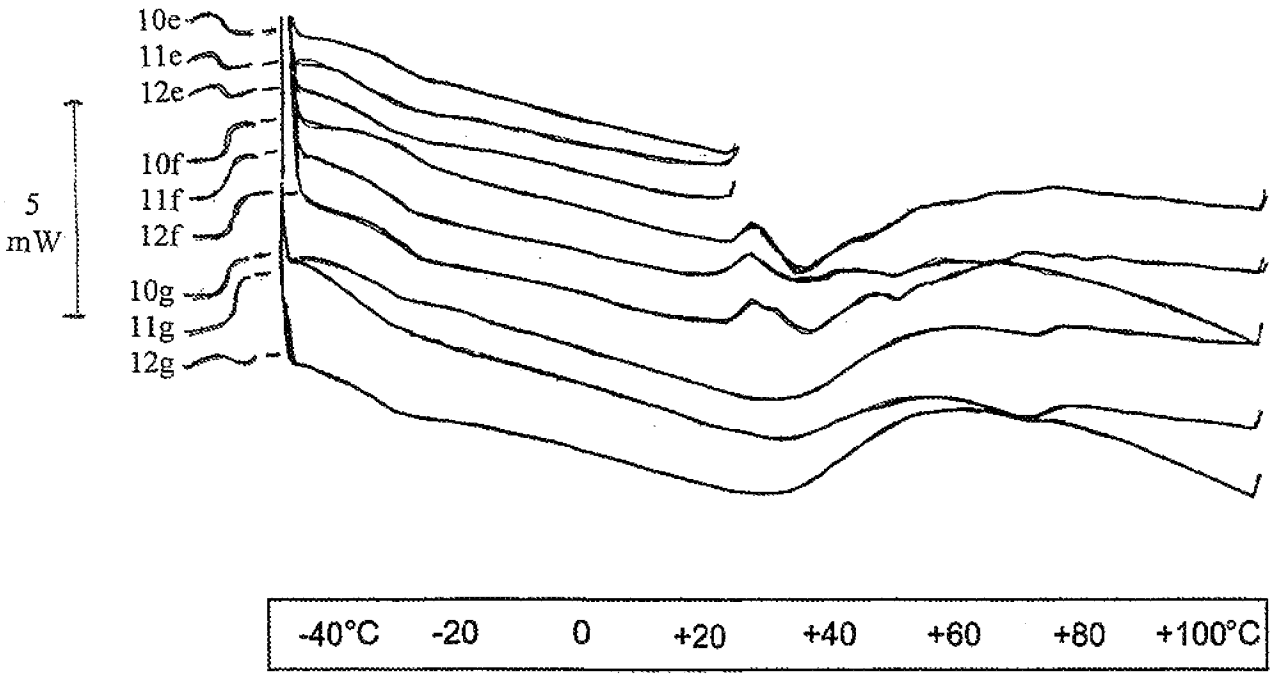
FIG. 7 is part of the differential scanning calorimetry temperature log showing heating for the control bunker sample, of ionized-polarized crude sample 1 and ionized-polarized crude sample 2.
Figure 8:
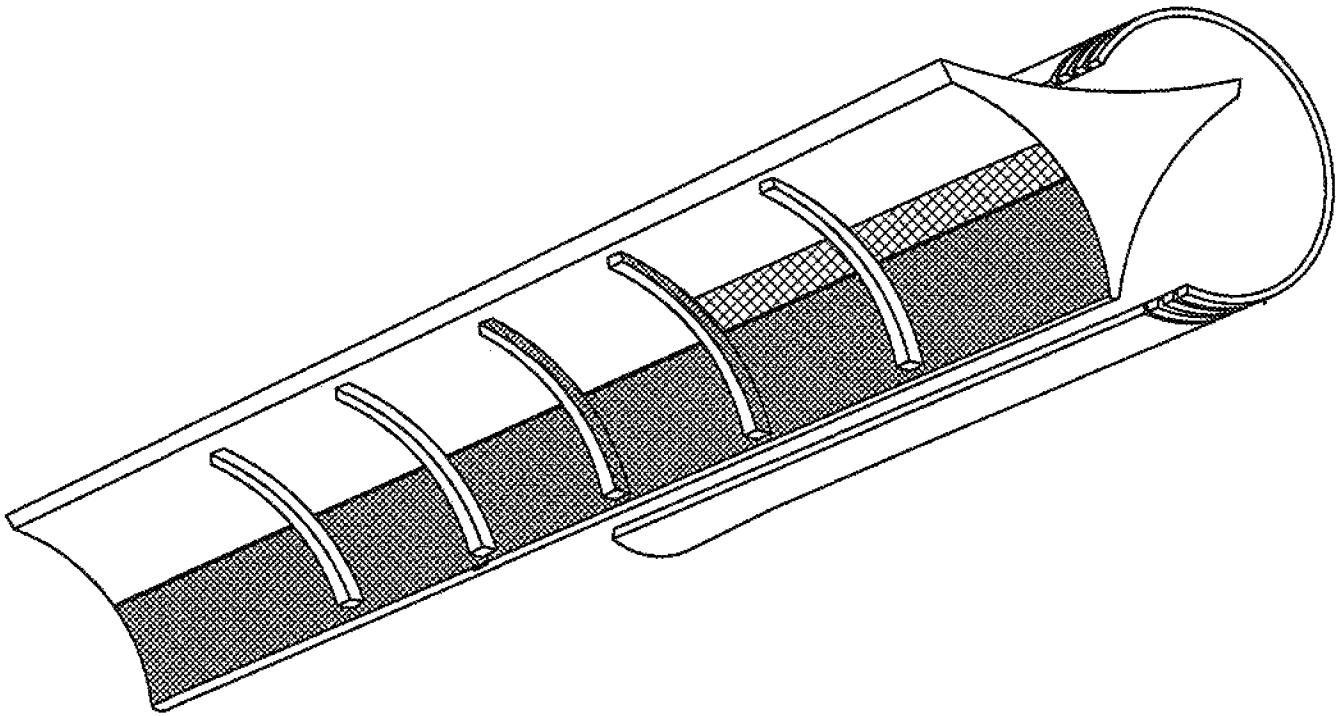
FIG. 8 is a demonstrative image with ionizer-polarizing device, where you can see Shell and core (Center).

FIG. 7 shows the DSC temperature log of all three (3) samples showing heating. Control crude oil (10), ionized-polarized crude oil sample 1 (11), and ionized-polarized crude oil sample 2 (12) are shown being heated at three temperatures. The samples were heated from −40° C. to 25° C. The results of this heating are shown as control crude oil (10*e*), ionized-polarized crude oil 1 sample (11*e*) and ionized-polarized crude oil sample 2(12*e*). The samples are heated from −40° C. to 100° C. The results of this heating is shown as control crude oil (100, ionized-polarized crude oil sample 1 (110 and ionized-polarized crude oil sample 2(12*f*). The samples were cooled and heated again from −40° C. to 100° C. The results of this heating is shown as control crude oil sample (10*g*), ionized-polarized crude oil sample 1 (11*g*) and ionized-polarized crude oil sample 2 (12*g*). In general, these DSC temperature logs show that control crude oil reflects a higher heat flow than the ionized-polarized crude oil samples. This is likely due to higher viscosity and a more complex molecular structure in the control crude oil sample than in the sample of ionized-polarized crude oil sample.

EXAMPLE II

The primary goal of the test was to determine the changes in the crude oil molecular structure when treated with the core. The method and the resulting treated crude oil was tested at INA d. d. Zagreb Croatia in Petroleum Products Quality Control Laboratory (wee www.ina.hr) and became evidence of ratification of decrease of viscosity and potentiation of dehydration by Comercializadora Teotihuitzu, S.A. de C.V. in Mexico.

Once signs of crude passed through the device object of this invention mounted on a bypass in the supply line, the collection process determined that the viscosity of the samples was less than the viscosity of Control crude oil (untreated crude).

The purpose of the testing was to establish potential differences between the untreated oil and crude oil treated with the device. The test was run in crude oil samples, which passed through the ionizer-polarizer device and oil samples from a reservoir in Kalinovici. In total, 2 samples of untreated crude oil and 2 samples of treated crude oil were processed for purposes of testinging of Croatia. For ratification testing in Mexico, were 2 samples of oil from the well of Samaria production 709, 2 samples of oil from the well of Samaria production 848 and 1sample of assets of Pemex Samaria II of head #93. 5 samples were treated and processed to determine decrease viscosity and dehydration, the results in Mexico were obtained and certified by Intertek Testing Services de Mexico, S.A. de C.V. (Results: Sample 709: 60% water mass as control; 55.7% water mass with ionizer only; 1.09% water mass with ionizer and chemical dehydrator. Sample 848: 2.14% water mass as control; 5.11% water mass with inionizer only; 1.34% water mass with ionizer and chemical dehydrator. Sample 93: 6.22% water mass as control with dehydrator chemical; 1.25% water mass with ionizer and chemical dehydrator.) Two methods were used for testing in Croatia: (a) SEM (scanning electron microscope) which is a microscopic observation of the surface of the crude oil and (b) DSC (differential scanning calorimetry) a thermal method that determines the specific heat of the crude oil. Two methods were used for testing of ratification in Mexico: (a) kinematic viscosity and(b) water in crude oil by potentiometric titration of Karl Fischer. Tables IV to IX show the results of initial testing performed on samples to show their inherent properties.

TABLE IV

Quality Control for Ionized-Polarized Crude Oil Sample

| Features | Units | Cutoff | Result | Method |
|---|---|---|---|---|
| Carbon residue MICROCARBON | — | | | HRN EN ISO 10370 |
| Carbon residue on overall sample | % m/m | <15 | 2.56 | HRN EN ISO 10370 |
| Ash (oxide) - instrumental method | % m/m | <0.2 | 0.177 | HRN EN ISO 6245 |
| Flash point closed, PM | ° C. | >70 | 124.5 | ASTM D 93: 10 (A procedure) |
| Pour point | ° C. | <40 | 36 | HRN ISO 3016: 97 |
| Kinematic viscosity at certain temperature | — | | | ASTM D 7042: 10 |
| Kinematic viscosity at 100° C. | $mm^2/s$ | 6-26 | 24.58 | ASTM D 7042: 10 |
| Sulfur wave-dispersive X-Ray | % m/m | <1 | 0.93 | ASTM D 2622 |

TABLE V

Two-Dimensional Gas Chromatography for Ionized-Polarized Crude Oil Sample Quality Control

| Features | Units | Cutoff | Result | Method |
|---|---|---|---|---|
| GCxGC - Comprehensive Two-dimensional gas chromatography (determining group composition in petroleum and middle distillates, diesel fuel and light cyclic oils) | | | | Own method (for GCxGC) |
| Paraffins - total | % m/m | | 47.79 | Own method (for GCxGC) |
| n- paraffins | % m/m | | 16.95 | Own method (for GCxGC) |
| iso-paraffins | % m/m | | 14.01 | Own method (for GCxGC) |
| cyclo-paraffins - naphthenic | % m/m | | 16.83 | Own method (for GCxGC) |
| Paraffins (n-; iso-) | % m/m | | 30.96 | Own method (for GCxGC) |
| Olefins | % m/m | | | Own method (for GCxGC) |
| Arenes - total | % m/m | | 52.21 | Own method (for GCxGC) |
| mono-arenes | % m/m | | 11.74 | Own method (for GCxGC) |
| di-arenes | % m/m | | 30.34 | Own method (for GCxGC) |
| tri-arenes | % m/m | | 10.13 | Own method (for GCxGC) |
| poly-arenes | % m/m | | 40.47 | Own method (for GCxGC) |
| Biphenyls | % m/m | | | Own method (for GCxGC) |

TABLE VI

Quality Control for Ionized-Polarized Oil Sample at 100° C. (4 months old)

| Features | Units | Cutoff | Result | Method |
|---|---|---|---|---|
| Carbon residue MICROCARBON | — | | | HRN EN ISO 10370 |
| Carbon residue on overall sample | % m/m | <15 | <0.01 | HRN EN ISO 10370 |
| Ash (oxide) - instrumental method | % m/m | <0.2 | <0.001 | HRN EN ISO 6245 |
| Flash point closed, PM | ° C. | >70 | 118.5 | ASTM D 93: 10 (A procedure) |
| Pour point | ° C. | <40 | 0 | HRN ISO 3016: 97 |

TABLE VI-continued

Quality Control for Ionized-Polarized Oil Sample at 100° C. (4 months old)

| Features | Units | Cutoff | Result | Method |
|---|---|---|---|---|
| Kinematic viscosity at certain temperature | — | | | ASTM D 7042: 10 |
| Kinematic viscosity at 100° C. | $mm^2/s$ | 6-26 | 23.51 | ASTM D 7042: 10 |
| Sulfur wave-dispersive X-Ray | % m/m | <1 | 0.9 | ASTM D 2622 |

TABLE VII-V

Two-Dimensional Gas Chromatography- Quality Control for Ionized-Polarized Crude Oil Sample(4 months old)

| Features | Units | Cutoff | Result | Method |
|---|---|---|---|---|
| GCxGC - Comprehensive Two-dimensional gas chromatography (determining group composition in petroleum and middle distillates, diesel fuel and light cyclic oils) | | | | Own method (for GCxGC) |
| Paraffins - total | % m/m | | 48.73 | Own method (for GCxGC) |
| n- paraffins | % m/m | | 21.47 | Own method (for GCxGC) |
| iso-paraffins | % m/m | | 13.78 | Own method (for GCxGC) |
| cyclo-paraffins - naphthenic | % m/m | | 13.48 | Own method (for GCxGC) |
| Paraffins (n-; iso-) | % m/m | | 32.25 | Own method (for GCxGC) |
| Olefins | % m/m | | | Own method (for GCxGC) |
| Arenes - total | % m/m | | 51.27 | Own method (for GCxGC) |
| mono-arenes | % m/m | | 12.34 | Own method (for GCxGC) |
| di-arenes | % m/m | | 28.83 | Own method (for GCxGC) |
| tri-arenes | % m/m | | 10.1 | Own method (for GCxGC) |
| poly-arenes | % m/m | | 38.93 | Own method (for GCxGC) |
| Biphenyls | % m/m | | | Own method (for GCxGC) |

TABLE VIII

Quality Control for Ionized-Polarized Crude Oil Sample to 110° C. (4 months old)

| Features | Units | Cutoff | Result | Method |
|---|---|---|---|---|
| Carbon residue MICROCARBON | — | | | HRN EN ISO 10370 |
| Carbon rescue on overall sample | % m/m | <15 | <0.01 | HRN EN ISO 10370 |
| Ash (oxide) - instrumental method | % m/m | <0.2 | <0.001 | HRN EN ISO 6245 |
| Flash point closed, PM | ° C. | >70 | 116.5 | ASTM D 93: 10 (A procedure) |
| Pour point | ° C. | <40 | 6 | HRN ISO 3016: 97 |
| Kinematic viscosity at certain temperature | — | | | ASTM D 7042: 10 |
| Kinematic viscosity at 100° C. | $mm^2/s$ | 6-26 | 23.48 | ASTM D 7042: 10 |
| Sulfur wave-dispersive X-Ray | % m/m | <1 | 0.9 | ASTM D 2622 |

The table IX—Quality Control for Ionized-Polarized Crude oil Sample at 110° C.(4 months old)

The table IX- Quality Control for Ionized-Polarized Crude Oil Sample at 110° C. (4 months old)

| Features | Units | Cutoff | Result | Method |
|---|---|---|---|---|
| Carbon residue MICROCARBON | — | | | HRN EN ISO 10370 |
| Carbon residue on overall sample | % m/m | <15 | <0.01 | HRN EN ISO 10370 |
| Ash (oxide) - instrumental method | % m/m | <0.2 | <0.001 | HRN EN ISO 6245 |
| Flash point closed, PM | ° C. | >70 | 116.5 | ASTM D 93: 10 (A procedure) |
| Pour point | ° C. | <40 | 3 | HRN ISO 3016: 97 |
| Kinematic viscosity at certain temperature | — | | | ASTM D 7042: 10 |
| Kinematic viscosity at 100° C. | $mm^2/s$ | 6-26 | 23.17 | ASTM D 7042: 10 |
| Sulfur wave-dispersive X-Ray | % m/m | <1 | 0.9 | ASTM D 2622 |

SEM Testing—Scanning Electron Microscope

For the purpose of SEM testing, a microscope JEOL 5800 was used, equipped with corresponding detectors. One of the important conditions for this SEM test is that the sample needs to be stable in high vacuum. To ensure stability, a drop of crude oil was disposed on a glass smeared, to get as thin and homogeneous smear as possible. The smear was dried and gold plated to ensure good electrical transmittance and therefore a better image. Cavities or holes were spotted, smaller and bigger. For the crude oil samples that had passed through the ionizer-polarizer core, the number of those cavities or holes was significantly greater. Particles' sizes were between 10-30 m. Particles were not usually spotted with crude oil treated with the ionizer-polarizer core, but only the cavities of different size and shapes.

DSC Testing

This testing was conducted with Perkin Elmer DSC-7 calorimeter. Testing was done within the temperature range of 30° C. to 150° C., recording speed of 10° C./min in oxygen current. Small amounts of sample weighing a few milligrams were measured.

In conclusion, the test has shown that certain significant difference exists between untreated crude oil and crude oil treated with the ionizer-polarized core. Namely, the viscosity of the treated crude oil was lowered such that the crude oil maintained a liquid state without heat. Moreover, the treated samples had a significant reduction in the content of sulfur contaminants. The tests confirmed that exposure of the crude oil in liquid to the core, changed the crude oil liquid point from 30° C. to 0° C. The volatility or flash point decreased from 124.5° C. to 116.5° C.

Based on previous experience on exposing crude oil to the ionizer-polarized core which creates catalytic reactions, it was concluded that the reaction causes molecular separation with an electric charge. Because of molecular separation and the electric charge, mass changes and reflection or repulsion of particles with the same charge leads to changes in the physical performance like liquefaction and lower viscosity.

While crude oil passes over the ionizer-polarizer device because of the present invention, the electrostatically charged molecules of crude oil now with the same polarity repel each other and thus create a finer structure in the molecular chain of crude oil. This fine structure allows that treated oil being transported or pumped more easily and involving lower costs.

The claims appended hereto are meant to cover modifications and changes within the scope and spirit of the present invention.

What is claimed is:

1. A method for reducing sulfur contaminants and lowering viscosity in a crude oil and the potentiation of dehydration comprising:

passing the crude oil over a core that ionizes-polarizes the crude oil with an electrostatic charge;

wherein the core consists of a metal bar being made of an alloy comprising, by weight, 40-70% copper, 10-32% nickel, 15-40% zinc, 2-20% tin, and 0.05-10% silver;

wherein in the core is within a casing having an inlet and an outlet at its ends for receiving and discharging the crude oil to be treated; and wherein the core is disposed in a crude oil supply line.

2. The method of claim 1, wherein the metal bar of the core comprises a plurality of cuts having a concave shape and arranged diagonally along an entire surface of an upper and lower face of the metal bar of the core to create grooves, which allows the crude oil to be agitated as it comes in contact with the core, activating the electrostatic charge.

3. The method of claim 2, wherein the electrostatic charge creates a magnetic catalytic reaction that causes a molecular separation in molecular chains within the crude oil thereby lowering the viscosity of the crude oil.

4. The method of claim 2, wherein the electrostatic charge creates a magnetic catalytic reaction that causes an effect of stretching and torsion molecular, resulting in the potentiation of the dehydration of crude oil.

5. The method of claim 1, wherein the core is disposed in the crude oil supply line at a production site.

6. The method of claim 3, wherein the crude oil maintains a lower viscosity up to a year.

7. The method of claim 3, wherein the crude oil maintains a lower viscosity at temperatures above 0° C., such that the crude oil remains in a liquid state.

8. The method of claim 3, wherein the crude oil maintains a liquid state at temperatures in the range of 100° C. to 0° C.

9. The method of claim 1, wherein the crude oil maintains the electrostatic charge in their molecules that enhances dehydration.

10. A method for the potentiation of dehydration in a crude oil comprising:

passing the crude oil over a core that ionizes -polarizes it with an electrostatic charge;

wherein the core consists of a metal bar being made of an alloy comprising, by weight of, 40-70% copper, 10-32% nickel, 15-40% zinc, 2-20% tin, and 0.05-10% silver;

wherein the metal bar comprises a plurality of cuts having a concave shape and arranged diagonally along an entire surface of an upper and lower face of the metal bar of the core to create grooves, which allows the crude oil to be agitated as it comes in contact with the core, activating the electrostatic charge;

wherein the core is within a casing having an inlet and an outlet at its ends for receiving and discharging the crude oil that is being treated.

11. The method of claim 10, wherein the electrostatic charge creates a magnetic catalytic reaction that causes stretching and molecular torsion that induce the elimination of congenital and added water within the molecular bonds of the crude oil, which potentiates the dehydration.

12. A method for maintaining a crude oil in a liquid state comprising:

passing the crude oil over a core that ionizes-polarize it with an electrostatic charge;

wherein the core consists of a metal bar being made of an alloy comprising, by weight, 40-70% copper, 10-32% nickel, 15-40% zinc, 2-20% tin, and 0.05-10% silver;

wherein the metal bar of the core comprises a plurality of cuts having a concave shape and arranged diagonally along an entire surface of an upper and lower face of the metal bar from the Center bar to create slots, which can make the crude oil agitated while in contact with the core, activating the electrostatic charge;

wherein the core is within a casing having an inlet and an outlet at its ends for receiving and discharging the crude oil that is being treated.

13. The method of claim 12, wherein the electrostatic charge creates a magnetic catalytic reaction that causes a molecular separation in molecular chains within the crude oil thereby lowering the viscosity of the crude oil.

14. The method of claim 12, wherein the crude oil maintains its liquid state at temperatures whose lower limit is based on the 0° C.

15. The method of claim 12, wherein the crude oil maintains a liquid state at temperatures in the range of 100° C. to 0° C.

* * * * *